United States Patent [19]

Edwards

[11] 3,976,255

[45] Aug. 24, 1976

[54] JAW CRUSHERS

[75] Inventor: Albert Edwards, Peterborough, England

[73] Assignee: Baker Perkins Holdings Limited, Peterborough, England

[22] Filed: Mar. 13, 1975

[21] Appl. No.: 558,164

[30] Foreign Application Priority Data

Apr. 2, 1974 United Kingdom ..... 14558/74

[52] U.S. Cl. ..... 241/264

[51] Int. Cl.[2] ..... B02C 1/04

[58] Field of Search ..... 241/264, 266–269

[56] References Cited

UNITED STATES PATENTS

| | | | |
|---|---|---|---|
| 2,532,678 | 12/1950 | Shelton | 241/269 X |
| 2,605,051 | 7/1952 | Bogie | 241/264 X |
| 2,620,629 | 12/1952 | Gauldie | 241/264 X |
| 3,099,406 | 7/1963 | Kautz | 241/266 X |
| 3,166,259 | 1/1965 | Archer | 241/267 X |

FOREIGN PATENTS OR APPLICATIONS

| | | | |
|---|---|---|---|
| 1,276,422 | 8/1968 | Germany | 241/264 |
| 1,237,414 | 3/1967 | Germany | 241/264 |

*Primary Examiner*—Granville Y. Custer, Jr.
*Assistant Examiner*—Howard N. Goldberg
*Attorney, Agent, or Firm*—Larson, Taylor & Hinds

[57] ABSTRACT

A jaw crusher is provided with a pressure relieving system to allow a movable jaw of the crusher to yield in case of an excess crushing load. The movable jaw is urged outwardly by a spring and an hydraulic ram exerts inward pressure on the jaw against the spring action. The ram has a control system for reducing the ram pressure when an excess load is encountered allowing the spring to move the jaw outwardly and after a suitable time delay for re-establishing the pressure within the ram to return the jaw to its inner position against the spring action.

4 Claims, 2 Drawing Figures

JAW CRUSHERS

This invention relates to jaw crushers as used for example in sand reclamation plants for crushing aggregates of material from used foundry moulds or cores in the reclamation of chemically bonded moulding sand.

It is already known to provide hydraulically operated jaw crushers wherein excessive pressure will force oil out of a cylinder into a reservoir or accumulator, allowing a movable jaw of the crusher to yield in the presence of tramp metal. There is a problem, however, that some tramp metal may not be digested because at a certain point the pressure is maintained on the jaw and holds the tramp metal in place.

An object of the present invention is to provide a jaw crusher for foundry moulding sand which is more efficient and quicker in dealing with tramp metal.

According to the present invention a jaw crusher is provided with a pressure relieving system comprising a fluid pressure cylinder for holding a movable crusher jaw in a normal operating position, against the action of a resilient member urging the jaw outwardly from said operating position, a control system for exhausting fluid from the cylinder when crushing pressure on the movable jaw rises above a predetermined value to allow the resilient means to move the jaw outwardly to a pressure relieving position and for subsequently readmitting pressure fluid to the cylinder to return the jaw to said normal operating position against the action of the resilient means. Preferably the fluid pressure cylinder is an hydraulic cylinder, and the control system includes an air/liquid intensifier unit for controlling liquid pressure within the cylinder by the supply and exhaust of air to and from the unit.

The invention will now be described by way of an example with reference to the accompanying drawings in which.

Figure 1:
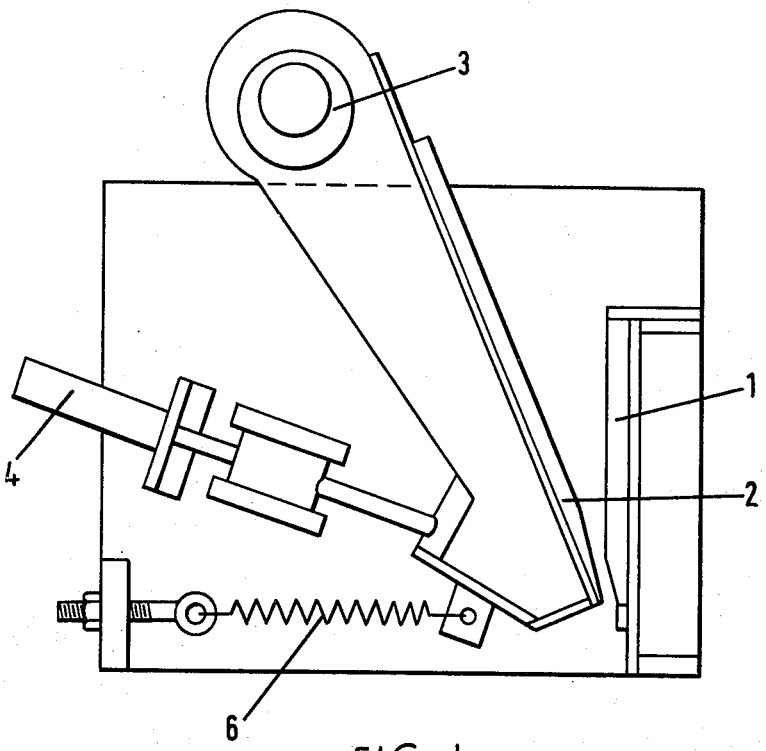
FIG. 1 is a diagrammatic side view of a jaw crusher for use in a sand reclamation plant.

In FIG. 1 a jaw crusher is shown which basically comprises a fixed vertical jaw 1 and a movable jaw 2. The movable jaw is journalled to an eccentric 3 for reciprocatory movement relative to the fixed jaw for crushing agglomerate material, received from a feed point, between the jaws. A ram and toggle arrangement 4 is provided for exerting pressure on the movable jaw for crushing agglomerate material between the jaws. When the pressure between the jaws exceeds a predetermined value as the result of hard substances, such as tramp metal entering between the jaws, the pressure on the ram is relieved by exhaust of pressure fluid from the ram and through the medium of a tension spring 6, the movable jaw is pulled outwardly, thus, allowing tramp metal to fall through the jaws.

Figure 2:
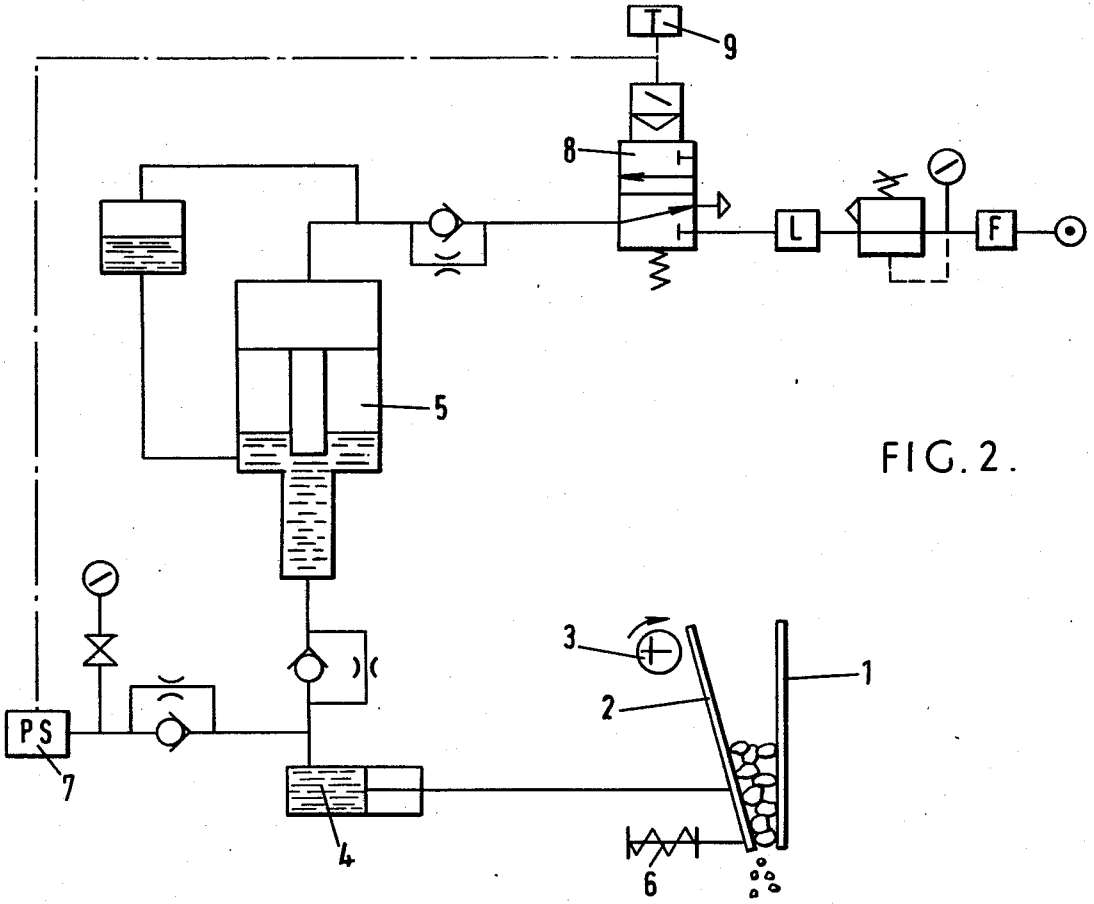
FIG. 2 shows a pneumatic/hydraulic circuit for the crusher shown in FIG. 1.

The method of operation, see FIG. 2, is as follows:

Sand and tramp metal are delivered into the jaws of the crusher. The crusher has a fixed vertical jaw 1 and a movable inclined jaw 2. The movable jaw is given a crushing motion by means of an eccentrically driven shaft through an eccentric 3. The bottom of the movable jaw is held in position against the weight of the sand by an hydraulic ram 4.

A compressed air supply provides power to the hydraulic ram on the crusher, via an air/oil intensifier unit 5 against the action of a tension spring 6. When tramp metal enters the jaws and becomes lodged, a back pressure is created increasing the pressure in the ram. Once the pressure build-up in the ram reaches a predetermined level, a pressure sensitive switch 7 is actuated. This in turn operates a solenoid operated/spring return valve 8 and a timing device 9. The solenoid valve exhausts the air supply to the intensifier unit 5, thereby reducing the pressure on the ram 4 and allowing the tension spring 6 to pull the bottom of the movable jaw 2 outwardly away from the fixed jaw 1. This allows the tramp metal to fall further through or completely through the crusher jaws. Uni-directional restrictors regulate the speed at which the jaws are opened. The timer 9 after a predetermined delay e.g. 5 secs. actuates the solenoid valve 8 to re-pressurise the system so that pressure in the ram is restored thereby returning the movable jaw to its inner position against the action of the spring 6. The cycle can then be repeated until the tramp metal is cleared. When large tramp metal enters the jaws of such dimension that it will not allow tramp metal to pass through, then a suitable limit switch is actuated by the movable jaw 2 in the fully open position to shut down the crusher and any associated equipment.

I claim:

1. A jaw crusher including a pressure relieving system comprising a fluid pressure cylinder for holding a movable crusher jaw in a normal operating position, against the action of a resilient member urging the jaw outwardly from said operating position, and a control system for exhausting fluid from the cylinder when crushing pressure on the movable jaw rises above a predetermined value to allow the resilient means to move the jaw outwardly to a pressure relieving position and for subsequently readmitting pressure fluid to the cylinder to return the jaw to said normal operating position against the action of the resilient means, said fluid pressure cylinder comprising a hydraulic cylinder, and said control system including an air/liquid intensifier unit for controlling liquid pressure within the cylinder by the supply and exhaust of air to and from said unit.

2. A jaw crusher as claimed in claim 1 wherein the intensifier unit is operated through a switch sensitive to liquid pressure in the cylinder.

3. A jaw crusher as claimed in claim 2 wherein the switch is operative to exhaust air from said unit to relieve pressure in the cylinder when the pressure in the cylinder rises above the predetermined value and a timer is provided to re-supply air to said unit after a suitable time-delay to increase the pressure in the cylinder.

4. A jaw crusher as claimed in claim 3 wherein the timer and the switch are connected to a solenoid-operated valve for supplying air to and exhausting air from said unit.

* * * * *